US005868649A

United States Patent [19]

Erickson et al.

[11] Patent Number: 5,868,649

[45] **Date of Patent: *Feb. 9, 1999**

[54] AQUATIC EXERCISE DEVICE

[75] Inventors: Curtis Erickson, Palm City; Milton Velinsky, Palm Beach; Gary Yanik, Riviera Beach, all of Fla.

[73] Assignee: Hydrosplash Enterprises, Inc., Palm Beach, Fla.

[ * ] Notice: Under 35 U.S.C. 154(b), the term of this patent shall be extended for 20 days.

[21] Appl. No.: 599,084

[22] Filed: Feb. 9, 1996

[51] Int. Cl.[6] ..... A63B 21/008

[52] U.S. Cl. ..... 482/58; 482/111

[58] Field of Search ..... 482/111, 112, 482/57, 58, 53, 51

[56] References Cited

U.S. PATENT DOCUMENTS 4,776,583 10/1988 Jennings ..... 482/58

5,116,295 5/1992 Dunn et al. ..... 482/111

5,316,532 5/1994 Butler ..... 482/111

5,354,253 10/1994 Awbrey et al. ..... 482/111

*Primary Examiner*—Lynne A. Reichard

*Attorney, Agent, or Firm*—McAulay Nissen Goldberg Kiel & Hand, LLP

[57] ABSTRACT

An aquatic exercise device which is to be used within a body of water such as a pool has an element which can be engaged by the foot or hand of an individual, which element is linked to a piston-cylinder combination so that as the user engagement element is moved by the user the piston rides in the cylinder. At the head end of the cylinder there is an opening which provides communication between the cylinder chamber and the water environment. As the piston moves back and forth water is either pushed out of the chamber through that opening or drawn into the chamber through that opening. The size of the opening, which may be selected by the user, determines the degree of resistance to the user's movement against the user engagement element.

7 Claims, 4 Drawing Sheets

AQUATIC EXERCISE DEVICE

BACKGROUND OF THE INVENTION

This invention relates in general to an exercise device that is immersed in water.

It is well known that exercising in an aquatic environment is beneficial to the person doing the exercise because the resistance of the water aids in promoting muscle tone and the buoyancy of the individual relative to the water reduces the likelihood of muscle strain. Exercising in an aquatic environment is invigorating and motivating, in part because of the coolness of the pool water and in part because of the comfort due to the buoyancy of the water. An example of an aquatic exercise device is shown in U.S. Pat. No. 5,033,735 issued Jul. 23, 1991.

The value or utility of an exercise device is usually a function of it being adaptable to the needs of the individual user. Accordingly, it is an object of this invention to provide an aquatic exercise device which provides a user selectable level of resistance to the exercise motion.

In order to obtain widespread use of any given exercise device, it is important that it be relatively inexpensive, easy to use and to assemble, require minimum maintenance, be easy to install and remove and can be adapted to be used in a wide variety of environments.

Accordingly, it is further purpose of this invention to provide the user selected variable resistance function in the context of an inexpensive, simple device which requires minimum maintenance and is easy to install and remove.

BRIEF DESCRIPTION

In brief, the objects of this invention are met in a device which is inserted into a body of water for use and which employs the water itself as the critical medium for adjusting the degree of resistance to a particular body exercise motion. The device has a mechanism which is supported on the side of a pool. The device may have a seat or other support for the individual who is using it. The exercise device includes an element which the user grips or engages such as a foot pedal or hand grip. The user engagement element is coupled to the frame of the exercise device in such a fashion that it will move as the individual moves his or her hand or foot.

This movable user engagement member is coupled to a piston rod which has a piston head that is slip fit within a cylinder. The head end portion of the cylinder has an opening so that when the cylinder and piston are immersed in water, the opening provides communication of water between the pool and the chamber of the cylinder.

An annulus mounted around the head end of the cylinder has six openings that have different diameters. The cylinder opening under the annulus is covered by the annulus. As the user rotates the annulus, the single opening of the cylinder can be placed in registration with any one of the six openings of the annulus. In this fashion, the effective opening between the interior of the cylinder and the pool in which the device is immersed will be the diameter of one of the six openings of the annulus at the head end of the cylinder that is in registration with the single opening in the cylinder.

The size of the annulus opening will determine the resistance to movement of the piston head within the cylinder because the size of this opening will determine the rate at which water can readily be pushed out of the cylinder or pulled into the cylinder. The cylinder opening is at least as large as the largest annulus opening.

DESCRIPTION OF THE PREFERRED EMBODIMENTS

Figure 1:
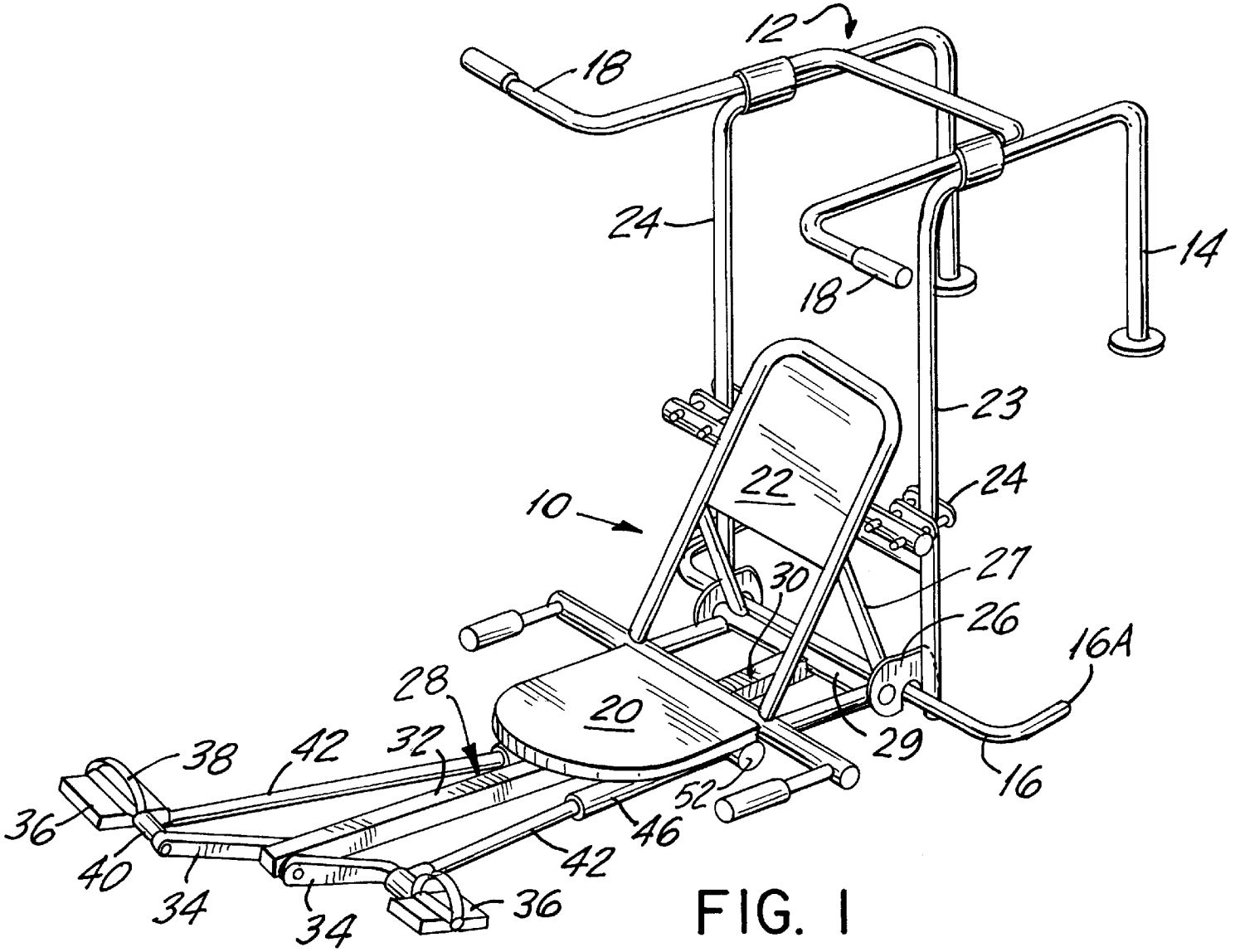
FIG. 1 is a perspective view of an embodiment of an aquatic exercise device according to the present invention.

The FIGs. all show a single embodiment. The aquatic exercise device 10 is shown connected to a frame 12. The frame 12 can be mounted at mounting bars 14 to a surface adjacent to a pool. The frame includes a further support bar 16 whose ends 16A abut against a sidewall in the pool to provide positioning and support for the exercise device 10. Frame handles 18 enable the user to lower himself or herself into a chair, which chair has a seat 20 and a back 22.

Figure 8:
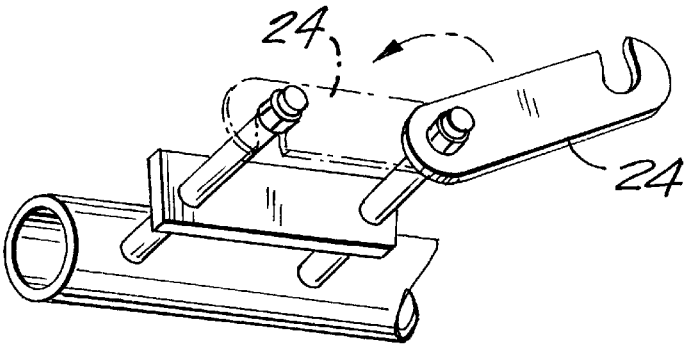
FIG. 8 illustrates one of the two clamps 24 which connect the back 22 of the chair to the support frame 12.
Figure 9:
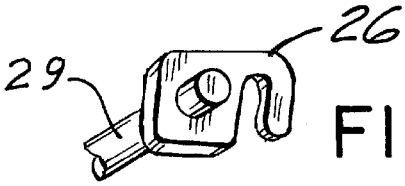
FIG. 9 illustrates one of the two hook attachments 26 which support the chair on the support frame 12.

The chair 20, 22 is supported on the frame 12 by two upper clamps 24 which clamp on the vertical rod 23 and which are shown in greater detail in FIG. 8; and by two lower hooks 26 shown in greater detail in FIG. 9; and by support rods 27. The seat 20 is supported on telescoping support bar 28 and more particularly on the rear member 30 of the telescoping support bar 28. The rear member 30 of this telescoping support bar 28 is connected to a transverse cylinder 29. This cylinder 29 in turn is supported on the bar 16 of the frame 12 by the two hooks 26.

The front member 32 of the telescoping bar 28 supports a pedal arrangement. This pedal arrangement has two crank links 34, two pedals 36 and two pedal straps 38. The straps aid in holding the user's foot on the pedals 36. An inboard extension element of each pedal 36 is supported in a bushing 40, which bushing is attached to one end of a link 34. Thus each pedal 36 is mounted for rotation about the axis of the bushing 40. The support bar end of each link 34 is rotatably mounted to the front end of the forward member 32 of the telescoping bar 28. Thus a full pedaling effect is obtained.

Adjustment of the telescoping support bar 28 permits the user to place the pedals 36 at an appropriate distance from the seat 20. In this fashion, device 10 can be adjusted to the height of the individual using it.

The frame of the bushing 40 associated with each pedal 36 is attached to a piston rod 42. The piston rod 42 connects to a piston head 44 that has a slip fit relationship to the inner wall of a cylinder 46. The piston head 44 is relatively lengthy compared to most piston heads in order provide an appropriate trade-off between ease of movement within the cylinder, avoiding racking within the cylinder and maintaining an effective seal of the chamber 49 within the cylinder 46.

At the forward or head end portion of the cylinder 46, there is an opening 48 through the wall of the cylinder. This opening 48 provides communication between the chamber 49 in the cylinder 46 and the environment outside of the cylinder 46.

Figure 6:
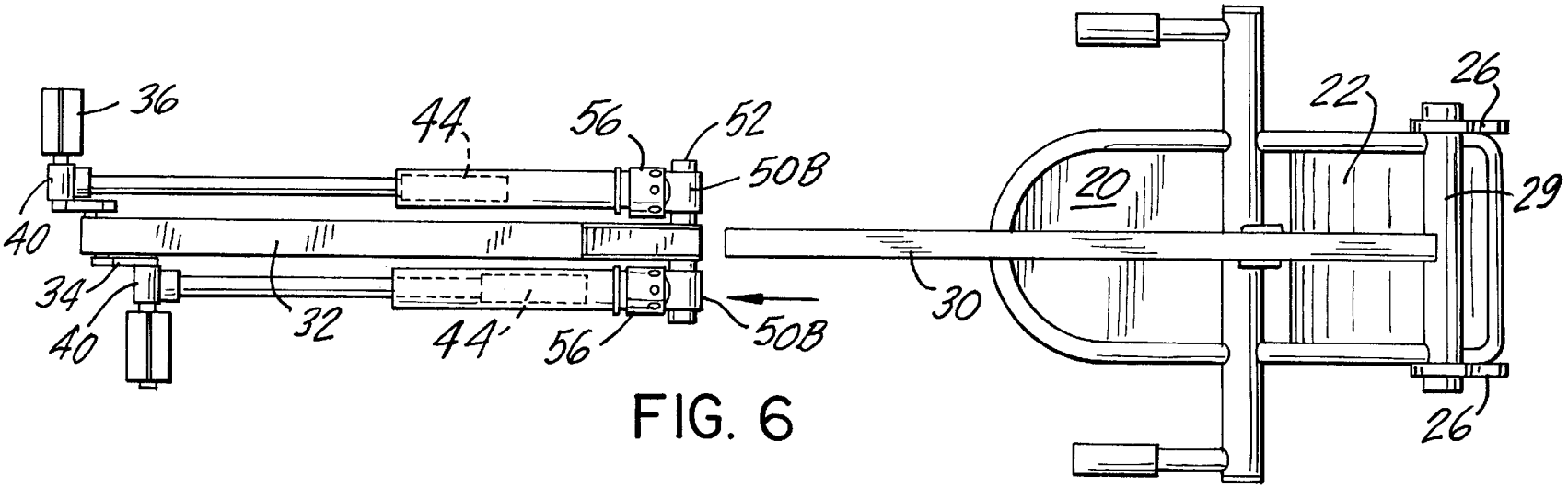
FIG. 6 is a view similar to that of FIG. 5 in which the forward portion 30 and rear portion 32 of the telescoping support bar 28 are separated.
Figure 7:
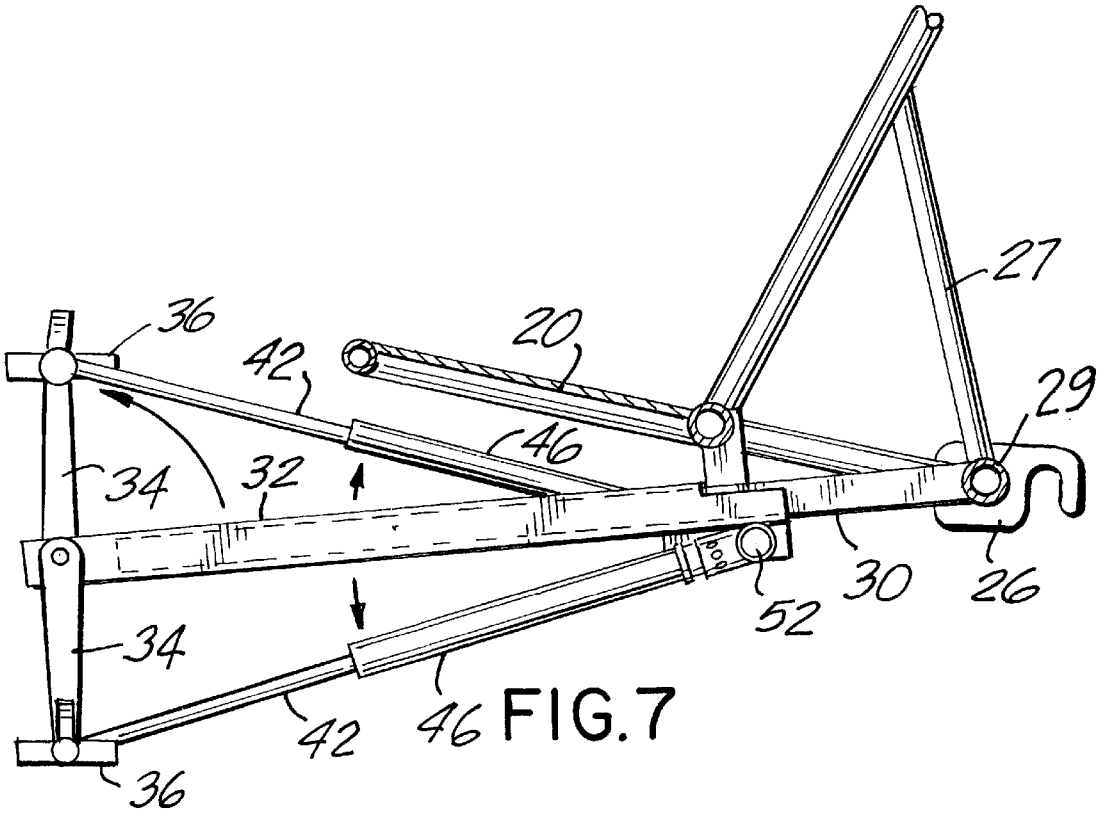
FIG. 7 is a side view illustrating the spacing between the support 52 for the cylinder 46 and the underside of the chair seat 20.

A T-shaped sleeve 50 supports the head end of the cylinder 46. The sleeve 50 in turn is supported on a transverse rod 52. The rod is connected to and spaced below the back end of the forward member of the telescoping support bar 28. Thus the assembly shown in the left hand portion of FIG. 6 is supported on the frame 12 by the engagement between the two portions 30, 32 of the telescoping support bar 28. The back portion 50B of the sleeve member 50 is a cylindrical segment mounted on the rod 52 for rotational movement about the axis of the rod 52. Thus the cylinder 46 and piston 42, 44 will rotate through the arc necessary to permit tracking with rotation of the links 34 as the links 34 rotate with the pedals 36. To permit this arcuate movement, the head end of the cylinder 46 has to be mounted so that it is spaced below the bar 28 and seat 20. The sleeve 50 has an opening 54 equal to and in registration with the cylinder opening 48.

Figures 2, 3, 4:
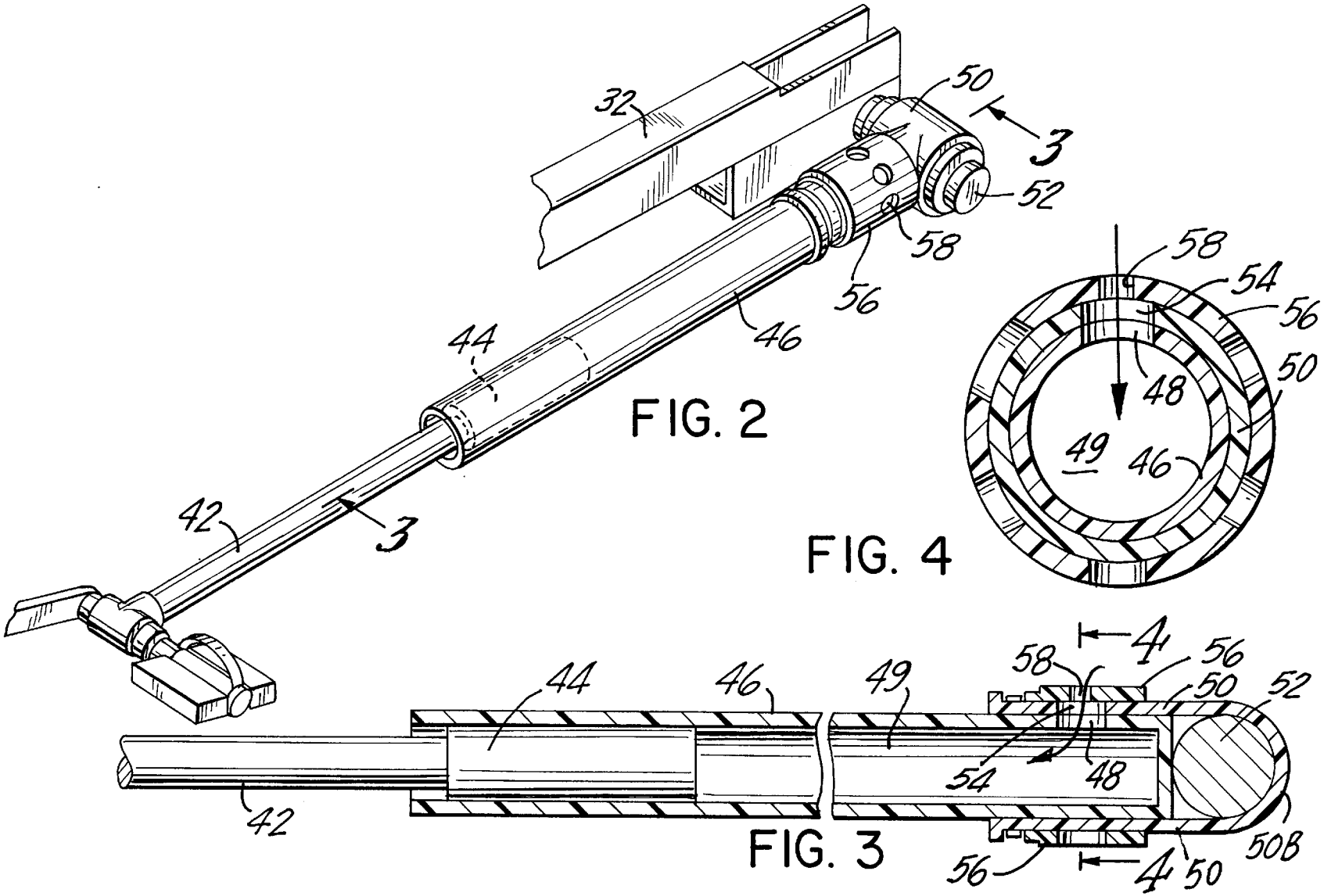
FIG. 2 is a perspective view of one of the two piston and cylinder arrangements in the FIG. 1 device showing openings 58 on a rotatable annulus 56 at the head end of the cylinder 46.
FIG. 3 is a longitudinal section along the plane 3—3 of FIG. 2 showing the opening 48 at the head end of the cylinder in communication with one of the openings 58 in the annulus 56.
FIG. 4 is a cross section along the plane 4—4 of FIG. 3 showing registration between an opening 58 on the annulus 56, the opening 54 in a support sleeve 50 and the opening 48 in the wall of the cylinder 46.
Figure 5:
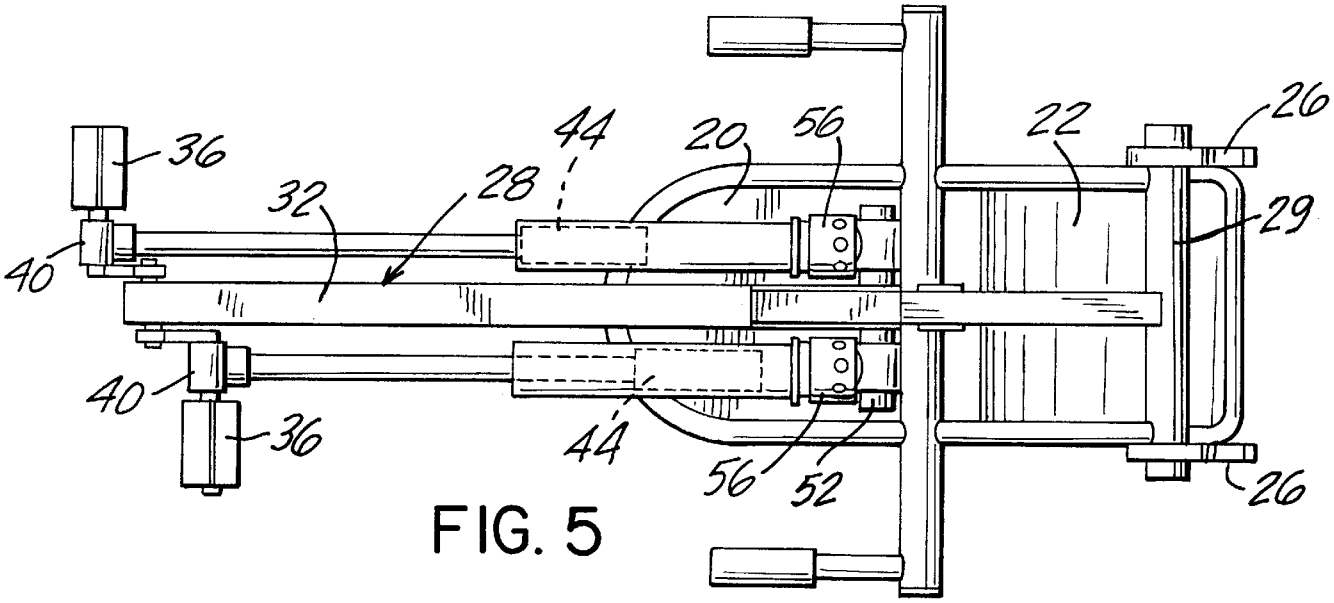
FIG. 5 is a perspective view of the underside of the FIG. 1 device illustrating the telescoping support bar 28 that permits adjusting the distance between pedals 36 and seat 20.

There is an annulus 56 which is mounted around the cylinder 46 at the head end of the cylinder. The annulus 56 covers the openings 48 and 54. The annulus has six openings 58. Each of these openings 58 has a different diameter, the largest being a diameter equal to that of the cylinder opening 48. The user can adjust the position of this annulus 56 by rotating it around the cylinder 46 so as to align one of the six openings 58 with the cylinder opening 48. FIG. 4 shows alignment of the smallest of the six openings of the annulus 56 with the opening 48 of the cylinder.

In operation, the user sits in the chair 20, 22 and places his or her foot on the pedals 36 using the straps 38 to hold each foot in place. It is this pedal 36 that is the element of the device 10 which engages the user. As the user pedals, the piston 42, 44 moves back and forth in the cylinder 46 either forcing water out of the openings 48, 58 or pulling water in through the openings 48, 58. The size of the annulus opening 58 determines the resistance to the user's pedaling and thus provides the required exercise device.

In one embodiment of the FIG. 1 device, there is a slip fit relationship between the piston head 44 and the inner wall of the cylinder 46. In that embodiment, the diameter of the piston head 44 is 1.5 inches and the inside diameter of the cylinder 46 is 1.5 inches. The cylinder outside diameter is two inches. The cylinder has a length of twenty-three inches and the piston head 44 is five inches long. The piston rod 42 is fourteen inches long and has a one inch diameter. This relatively long slip fit piston head 44 provides a useful-trade-off between creating an adequate seal between the piston head and the cylinder while avoiding the binding of the piston head to the cylinder wall. FIGS. 2 and 3 show the piston head 44 in its most retracted position. In that embodiment, a cast acrylic cylinder was used in order to obtain a consistent inside diameter so that the piston, which is made of polyvinyl chloride, is able to readily move back and forth within the cylinder. Thus the resistance to movement of the piston 42, 44 is primarily due to the resistance provided by the movement of water through the selected port 58 that is in alignment with the openings 48, 54.

Such a design avoids the need to employ O-rings or other sealing devices which would tend to deteriorate in the environment of a pool and would over time impose a variation in the resistance to movement of the user engagement member.

The six openings 58 have diameters of ¼, 5⁄16, ⅜, ½, ⅝ and ¾ inch. The underlying opening 48 in the cylinder is ¾ of an inch so that the positioning of the annulus opening over the cylinder opening determines the port diameter as equal to that of the sleeve opening 58.

A color coding of each sleeve opening will enable the user to readily reselect the degree of resistance sought by the user once the user has tested the various degrees of resistance.

Although this invention has been described in connection with a single embodiment, the inventor intends that this patent be understood to cover a variety of embodiments which should be obvious to those skilled in this art. For example, the plurality of holes could be in the cylinder 46 and the annulus 56 could have only one hole. Alternatively, many combinations of openings in the annulus and underlying cylinder could be employed. Furthermore, the annulus could be designed so that it has a single arcuate opening which overlaps a single arcuate opening in the cylinder so that the extent of the overlap would determine the net port size and thus the resistance provided.

Perhaps more significantly, the user engagement member, which in the embodiment shown, is the foot rest pedal 28 could be a hand engagement member so as to simulate, for example, a rowing machine. Alternatively, the foot engagement member could be connected to a linkage system that would simulate a ski machine or even a variable stepper as long as the links were then appropriately coupled to the piston and cylinder combination with the head end openings in communication with the water that determine the degree of resistance provided.

What is claimed is:

1. An aquatic exercise device adapted to be immersed in a body of water comprising:

a frame, a first movable user engagement member supported by said frame and movable between first and second positions, a first hydraulic resistance member including a cylinder and a piston, said piston defining a chamber within said cylinder, said cylinder having at least one adjustable port providing communication between said chamber and the body of water in which the aquatic exercise device is immersed, piston movement from a first position to a second position expanding said chamber and drawing water into said chamber through said port from the body of water and piston movement from said second position to said first position decreasing the volume of said chamber and forcing water from said chamber through said port into the body of water, said first position of said member determining said first position of said piston and said second position of said member determining said second position of said piston, resistance to the movement of said first user engagement member when said aquatic exercise device is immersed within a body of water being a function of the size of the opening of said port, said adjustable port comprising: at least one opening through said cylinder, and a rotatable sleeve mounted on said cylinder over said opening in said cylinder, said sleeve having a plurality of different size openings therethrough, the position of a sleeve opening in alignment with said cylinder opening determining the size of said port opening and thus providing a selection of the level of resistance to the movement of said user engagement member when said aquatic exercise device is immersed in a body of water.

2. An aquatic exercise device adapted to be immersed in a body of water comprising:

a frame, a first movable user engagement member supported by said frame and movable between first and second positions, a first hydraulic resistance member including a cylinder and a piston, said piston defining a chamber within said cylinder, said cylinder having at least one port providing communication between said chamber and the body of water in which the aquatic exercise device is immersed, piston movement from a first position to a second position expanding said chamber and drawing water into said chamber through said port from the body of water and piston movement from said second position to said first position decreasing the volume of said chamber and forcing water from said chamber through said port into the body of water, said first position of said member determining said first position of said piston and said second position of said member determining said second position of said piston resistance to the movement of said first user engagement member when said aquatic exercise device is immersed within a body of water being a function of the size of the opening of said port, said user engagement member rotating about and axis that is stationary relative to said frame, said piston and said cylinder being coupled at the piston end to said rotatable user engagement member and connected at the cylinder end to said frame, said connection between said cylinder end and said frame providing rotation of said cylinder end about an axis that is stationary relative to said frame.

3. An aquatic exercise device adapted to be immersed in a body of water comprising:

a frame, a first movable user engagement member supported by the frame and movable between first and second positions, a first hydraulic resistance member including a first cylinder and a first piston, said first piston defining a first chamber within said cylinder, said first cylinder having at least a first port providing communication between said first chamber and the body of water in which the aquatic exercise device is immersed, movement of said first piston from a first position to a second position expanding said first chamber and drawing water into said first chamber through said first port from the body of water and piston movement of said first from its second position to its first position decreasing the volume of said chamber and forcing water from said chamber through said first port into the body of water, said first position of said member determining said first position of said first piston and said second position of said member determining said second position of said first piston, and a second movable user engagement member supported by said frame and movable between third and fourth positions, said second hydraulic resistance member having the same structure as said first hydraulic resistance member including a second cylinder and a second port in said second cylinder, the response of said second hydraulic resistance member to movement of said second moveable user engagement member being analogous to the response of said first hydraulic resistance member to movement of said first user moveable engagement member, resistance to the movement of said first and second user engagement members when said aquatic exercise device is immersed within a body of water being respectively a function of the size of the opening of said first and second ports.

4. The aquatic exercise device of claim 1 wherein:

said user engagement member rotates about an axis that is stationary relative to said frame, said piston and said cylinder being coupled at the piston end to said rotatable user engagement member and connected at the cylinder end to said frame, said connection between said cylinder end and said frame providing rotation of said cylinder end about an axis that is stationary relative to said frame.

5. The aquatic exercise device of claim 3 wherein:

each of said first and second user engagement members rotate about an axis which is stationary relative to said frame, each of said hydraulic resistance members being coupled at the respective piston end to the associated one of said rotatable user engagement members and connected at the respective cylinder end to said frame, each of said connections between each of said cylinder ends and said frame providing rotation of each of said cylinder ends about an axis that is stationary relative to said frame.

6. The aquatic exercise device of claim 3 wherein:

said first and second ports each comprise: at least one opening through the associated one of said cylinders and a rotatable sleeve mounted on said associated cylinder over said opening in that cylinder, each of said sleeves having a plurality of different size openings therethrough, the position of a sleeve opening in alignment with the corresponding one of said cylinder openings determining the size of the associated port opening and thus providing a selection of the level of resistance to the movement of the associated one of said user engagement members when said aquatic devices are immersed in a body of water.

7. The aquatic exercise device of claim 3 wherein said first and second moveable user engagement members are comprised of first and second pedals adapted to engage the foot of a user, each of said pedals mounted for rotational pedaling movement relative to said frame to simulate leg movement on a bicycle.

* * * * *